US008758043B2

(12) United States Patent
Ohyama

(10) Patent No.: US 8,758,043 B2
(45) Date of Patent: Jun. 24, 2014

(54) FITTING CONFIRMATION CONSTRUCTION OF CONNECTOR FOR CONNECTING CIRCUIT BOARD

(75) Inventor: Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/602,695

(22) Filed: Sep. 4, 2012

(65) Prior Publication Data

US 2012/0322277 A1 Dec. 20, 2012

Related U.S. Application Data

(63) Continuation of application No. PCT/JP2011/058369, filed on Mar. 25, 2011.

(30) Foreign Application Priority Data

Mar. 26, 2010 (JP) ..... 2010-072777

(51) Int. Cl.
*H01R 13/62* (2006.01)

(52) U.S. Cl.
USPC ..... 439/489

(58) Field of Classification Search
USPC ..... 439/489, 357, 358
See application file for complete search history.

(56) References Cited

U.S. PATENT DOCUMENTS

| | | | | |
|---|---|---|---|---|
| 6,024,595 | A * | 2/2000 | Saba et al. | 439/489 |
| 6,146,183 | A | 11/2000 | Jinno et al. | |
| 7,052,310 | B2 * | 5/2006 | Matsunaga | 439/489 |
| 7,591,668 | B2 * | 9/2009 | Nakamura | 439/489 |
| 2002/0119693 | A1 | 8/2002 | Chen | |
| 2003/0194899 | A1 | 10/2003 | Ueda | |
| 2004/0002255 | A1 | 1/2004 | Ueda et al. | |
| 2005/0112935 | A1 * | 5/2005 | Nimura | 439/489 |
| 2007/0161284 | A1 * | 7/2007 | Tyler | 439/489 |
| 2008/0032545 | A1 * | 2/2008 | Lutsch et al. | 439/489 |
| 2010/0105238 | A1 * | 4/2010 | Good | 439/357 |

FOREIGN PATENT DOCUMENTS

| | | | |
|---|---|---|---|
| JP | 5343133 | A | 12/1993 |
| JP | 2003308924 | A | 10/2003 |
| JP | 2004363044 | A | 12/2004 |
| JP | 200685989 | A | 3/2006 |

OTHER PUBLICATIONS

International Search Report dated Jul. 27, 2011 from the International Searching Authority in counterpart international application No. PCT/JP2011/058369.

Written Opinion dated Jul. 27, 2011 from the International Searching Authority in counterpart international application No. PCT/JP2011/058369.

* cited by examiner

*Primary Examiner* — Gary Paumen
(74) *Attorney, Agent, or Firm* — Sughrue Mion, PLLC

(57) ABSTRACT

A fitting confirmation construction includes a confirmation part in a first connector and a confirmation opening in a second connector. A rib is provided in the confirmation opening. A height of the confirmation part is equal to a height of the rib and the confirmation part and the rib are positioned on a same line, on a viewing direction which is viewed from an obliquely upper position rearward in an inserting direction of the second connector through the confirmation opening, in a state that the second connector is completely fit with the first connector.

5 Claims, 5 Drawing Sheets

FITTING CONFIRMATION CONSTRUCTION OF CONNECTOR FOR CONNECTING CIRCUIT BOARD

CROSS REFERENCE TO RELATED APPLICATION

This application is a continuation of PCT application No. PCT/JP2011/058369, which was filed on Mar. 25, 2011 based on Japanese Patent Application (No. 2010-072777) filed on Mar. 26, 2010, the contents of which are incorporated herein by reference. Also, all the references cited herein are incorporated as a whole.

BACKGROUND OF THE INVENTION

1. Technical Field

The present invention is related to a fitting confirmation construction of a connector for connecting a circuit board. The fitting confirmation construction is used for implementing a visual confirmation of whether or not, for example, a flat-circuit-element-side connector is completely fitted to a circuit-board-side connector which is disposed between stacked circuit boards.

2. Background Art

Conventionally, various types of fitting confirmation constructions used in connecting a connector installed at an end of a flexible flat circuit element to a connector installed at an end of a hard printed circuit board are proposed.

JP-A-2006-85989 describes a fitting confirmation construction. In this construction, a plurality of terminals of conductive metal are disposed in parallel in a circuit-board-side connector so as to be exposed to an inside of a mating connector insertion port. A terminal of a flat circuit element is fixedly held between upper and lower guide members of a flat-circuit-element-side connector. Both of the connectors are fitted together, the terminals of the circuit-board-side connector are brought into elastic contact with a plurality of exposed conductors of the flat circuit element within the mating connector insertion port, and a projection on a flexible lock arm of the flat-circuit-element-side connector is brought into elastic engagement within a hollow portion in an upper wall of the circuit-board-side connector. Then, the worker is allowed to recognize a complete fitting connection of the connectors by hearing an engagement sound and visually confirming the projection.

JP-A-2003-308924 describes a locking construction for a flat-circuit-element-side connector. In this locking construction, locking piece portions are provided at distal ends of a pair of left and right substantially L-shaped flexible leg portions, and lock releasing levers are folded back in parallel to the leg portions from both left-hand and right-hand sides of the locking pieces portions.

JP-A-5-343133 describes a fitting confirmation construction. In this construction, an opening and an inclined guide rib are provided in an upper wall of one of connectors for not a flat circuit element but a wiring harness connection connectors, and a flexible arm which follows the guide rib and a mark at a distal end of the arm are provided in the other connector, so that when connectors are fitted together, the mark is caused to be positioned within the opening for recognition by the worker who fits the connectors together.

JP-A-2004-363044 also describes a fitting confirmation construction in which when connectors are fitted together, a different colored portion of the other connector is positioned within an opening in one connector.

SUMMARY OF THE INVENTION

In the conventional fitting confirmation constructions described in PTLs 1 to 4, however, like an example shown in FIG. 11, for example, when circuit-board-side connectors 1 are fixedly placed at one end of a hard circuit board 23, since an other circuit board package part 33 is disposed in front of (at the rear of) the connectors, and additionally, like an example shown in FIG. 12, when at least two upper and lower circuit boards 23, 23' are disposed one above the other, since the upper and lower circuit boards 23, 23' are connected together by connecting walls 34 at left- and right-hand side portions, when a flat-circuit-element-side connector 2' is fittingly connected to the lower circuit-board-side connector 1, the visual confirmation from the top, front or sides cannot be implemented due to the upper circuit board 23', the other circuit board package part 33 and the connecting walls 34. Thus, as shown in FIG. 13, whether or not both the connectors 1, 2' are fitted together properly has to be confirmed visually from the rear (an inserting direction of the flat-circuit-element-side connector 2') or from an obliquely upper position at the rear. The visual confirmation from the obliquely upper position at the rear causes a problem that the visual confirmation on whether or not both the connectors are fitted together properly by looking at the external appearance thereof is difficult.

In addition, the way of confirming the proper connectors fitting connection by visually confirming the movement of the marked arm as described in PTL 3 or the differently colored housing as described in PTL 4 has caused a problem that costs involved become high. The "rear" is referred to as so when the distal end side of the flat-circuit-element-side connector 2' is referred as "front" and the direction in which a flat circuit element 14 is led out is referred to as "rear."

It is therefore one advantageous aspect of the present invention to provide a circuit boards connecting connectors fitting confirmation construction which a visual confirmation of proper connectors fitting connection in fittingly connecting a flat-circuit-element-side connector to a circuit-board-side connector from an oblique direction with respect to the fittingly connecting direction simply and in an ensured fashion and moreover, with a simple and low-cost construction.

According to one aspect of the present invention, there is provided a fitting confirmation construction of a connector for connecting a circuit board, the connector including a first connector which is provided on the circuit board and a second connector which is provided at a flat circuit element and configured to be inserted into the first connector to be fit, the fitting confirmation construction comprising:

a confirmation part, provided at a housing of the first connector;

a confirmation opening, provided in a housing of the second connector; and a rib, provided in the confirmation opening, wherein a height of the confirmation part is equal to a height of the rib and the confirmation part and the rib are positioned on a same line, on a viewing direction which is viewed from an obliquely upper position rearward in an inserting direction of the second connector through the confirmation opening, in a state that the second connector is completely fit with the first connector.

The fitting confirmation construction may further comprise: a lock arm provided in the housing of the second connector; outer protection walls, provided on the housing of the second connector, and disposed at a left side and a right side of the lock arm respectively; and a lock projection provided on the housing of the first connector. A pair of confirmation openings may be provided between the lock arm and both of the left side and the right side of the outer protection walls respectively. The rib may be disposed rearward than the lock projection in the inserting direction in the state that the second connector is completely fit with the first connector.

The confirmation part may be a straight edge of the housing of the first connector. In the state that the second connector is completely fit with the first connector, a straight line connecting the straight edge with a front edge of the rib in the inserting direction may be equal to the viewing direction, and the front edge may be on the straight edge viewed in the viewing direction.

An angle between the straight line and the inserting direction may be in a range from 30 degree to 35 degree.

At least one other structure may be provided above the first connector or above and at sides of the first connector.

According to the present invention, when the confirmation of the proper fitting of the circuit-board-side connector (the first connector) and the flat-circuit-element-side connector (the second connector) is prevented by the other part lying in front thereof or cannot also be implemented from the top in relation to the position where the worker stands, by visually confirming the confirmation opening from the obliquely upper position at the rear of the flat-circuit-element-side connector, the complete fitting of both the connectors is confirmed when part of the housing of the circuit-board-side connector is positioned at the same height as that of the rib and on the same line, whereas when part of the circuit-board-side connector is spaced away in a front-to-rear direction from the rib at a different height, an incomplete fitting of both the connectors is detected. The coincidence of part of the housing with the rib is realized only when the confirmation opening is looked at from the obliquely upper position at the rear of the flat-circuit-element-side connector. For example, when the confirmation opening is looked at from directly above, part of the housing and the rib are slightly spaced away in the front-to-rear direction from each other. In reality, part of the housing and the rib are not contacted together.

According to the present invention, when the fitting confirmation of both the connectors cannot be implemented from the front due to being interrupted by the other part and cannot also be implemented from directly above due to the position where the worker stands, the fitting confirmation of both the connectors is implemented by visually confirming the confirmation opening from the obliquely upper position at the rear, and the complete fitting connection of both the connectors can be detected simply and in an ensured fashion and moreover, with a simple and low-cost construction by visually confirming that part of the housing of the one connector and the rib of the other connector coincide with each other within the confirmation opening.

According to the present invention, the substantially frame-shaped arm protection wall having the pair of left and right confirmation openings is positioned on the periphery of the lock arm, and the lock arm is protected against an external interference by the substantially frame-shaped arm protection wall. When the fitting state of both the connectors is looked at from directly thereabove, the complete fitting of both the connectors is detected by the engagement of the lock arm with the lock projection. However, the engagement of the lock arm with the lock projection cannot visually be confirmed from the obliquely upper position at the rear. It is not until the rib which lies further rearwards than the lock projection coincides with part of the housing that both the connectors are fitted together. By visually confirming the left and right confirmation openings at the same time, an oblique insertion of the connector is detected. In the oblique insertion, the position of the circuit-board-side connector differs to be shifted in the front-to-rear direction between the left and right confirmation openings.

According to the present invention, the oblique fitting connection of the connectors can be detected by visually confirming the pair of left and right confirmation openings at the same time. In addition, the visual confirmation when the connectors are fitted together can be implemented in an ensured fashion not by the engagement of the lock arm with the lock projection but by the rib which is situated further rearwards than the lock projection when the connectors are fitted together. Additionally, by providing the confirmation openings so as to extend as far as the arm protection wall of the housing, the connector construction can be made simple in construction and light in weight, and the conservation of resource of resin material can be realized. Further, by leaving the arm protection wall into the substantially frame-like fashion on the periphery of the confirmation openings, the protection of the lock arm can also be implemented together.

According to the present invention, although the connectors fitting confirmation cannot be implemented from above or from above and the sides physically, according to the configurations of the first and second aspects, whether or not the connectors are fitted together completely can be confirmed visually in the ensured fashion, and thus, there is caused no problem.

DETAILED DESCRIPTION OF THE EXEMPLARY EMBODIMENTS

Figure 1:
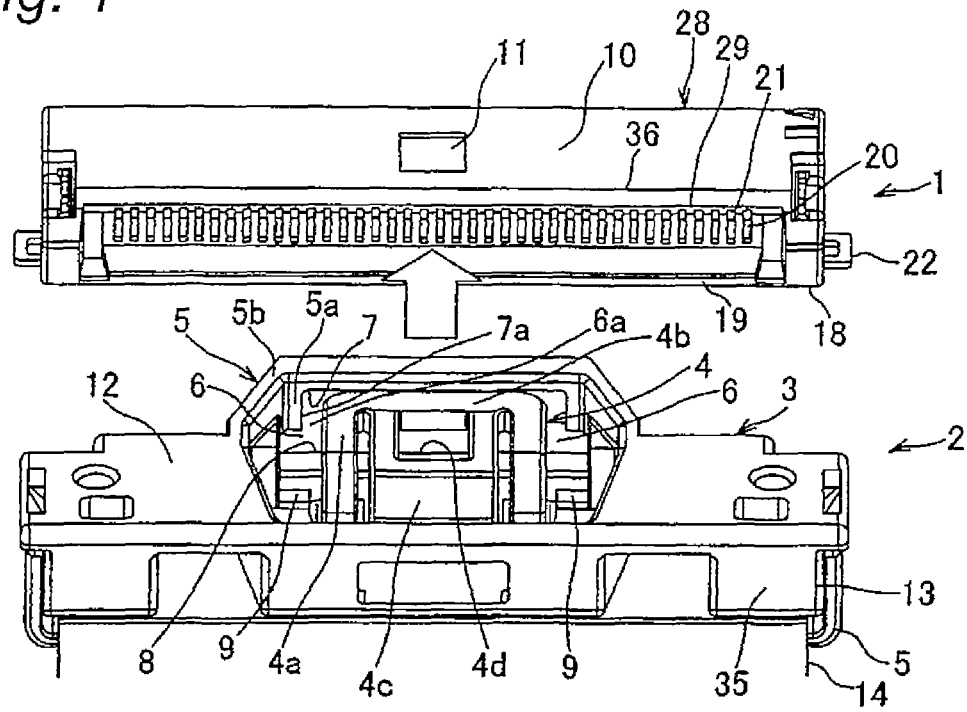
FIG. 1 is an exploded perspective view of an embodiment of a fitting confirmation construction for a circuit board connecting connector according to an embodiment of the invention, viewed from an obliquely upper position.

FIGS. 1 to 9 show an embodiment of a circuit board connecting connector fitting confirmation construction according to the invention. FIG. 1 shows a state resulting before a flat-circuit-element-side connector 1 is fitted to a circuit-board-side connector 1, the connectors 1, 2 being seen from an obliquely upper position at the rear. The circuit-board-side connector 1 and the flat-circuit-element-side connector 2 make up a circuit board connecting connector.

As is shown in FIG. 1, in a construction in which the flat-circuit-element-side connector 2 is fitted forwards as indicated by an arrow to the circuit-board-side connector 1, this circuit board connecting connector fitting confirmation construction is such that an upper opening (a confirmation opening) 6 is provided on each of left- and right-hand sides of a flexible lock arm 4 which is provided in a center in a width direction of a housing 3 formed of insulating resin of the flat-circuit-element-side connector 2 between a frame-shaped arm protection wall 5 and the lock arm 4, a front opening 7 which is wider than the lock arm 4 is provided in a vertical front end wall 5*a* of the arm protection wall 5 so as to communicate with the upper openings 6, a gap 6*a* is made to be formed individually between left- and right-hand side edges 7*a* of the opening 7 and left- and right-hand side portions 4*a* of the lock arm 4 when looked at obliquely upwards, and a pair of left and right ribs 9 for confirming a fitting position with respect to the circuit-board-side connector 1 are provided on an upper surface of a bottom wall 8 of the housing 3 within the upper openings 6 between the side portions 4*a* of the lock arm 4 and the arm protection wall 5.

Figure 2:
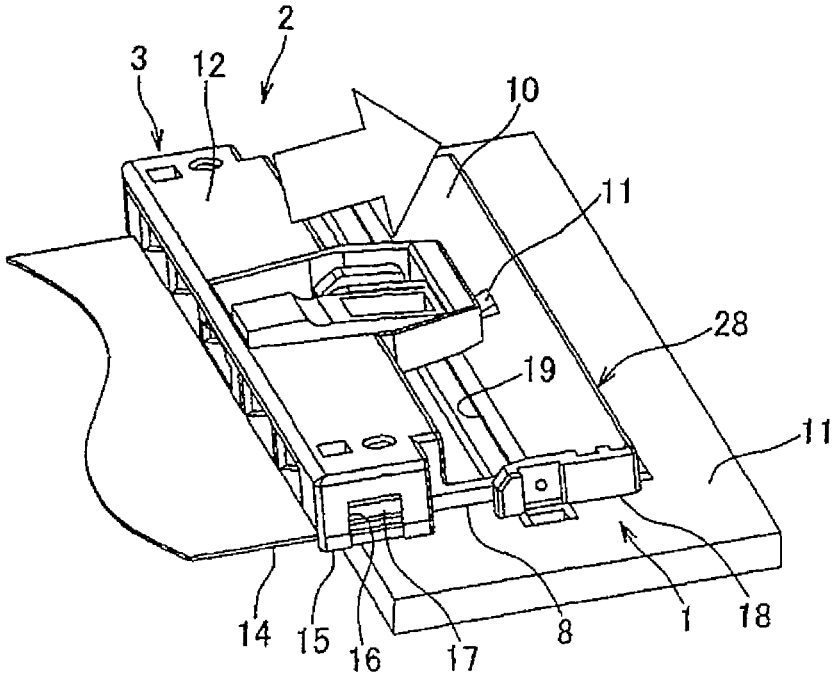
FIG. 2 is a perspective view showing a state before the circuit board connecting connector is fitted together.

As is shown in FIGS. 1, 2, the lock arm 4 is a conventionally existing one and has substantially L-shaped, flexible leg portions 4*a* which are caused to rise from the bottom wall 8 of the housing 3, a connecting piece 4*b* which connects front ends of the leg portions 4*a*, a frame-shaped lock release portion 4*c* which is extended to the rear from the connecting piece 4*b* and a locking hollow portion 4*d* which is provided in a center in a width direction of the lock release portion 4*c*. When both the connectors 1, 2 are fitted together, a lock projection 11 on an upper wall 10 of a housing 28 formed of insulating resin of the circuit-board-side connector 1 is brought into engagement with the locking hollow portion 4*d*.

The arm protection wall 5 is situated to be slightly higher than the lock arm 4 on the periphery of the lock arm 4 and includes left and right inclined side walls 5*b* and a front end wall 5*a* which connects both the side walls 5*b*. The respective side walls 5*b* integrally continue to a front end of an upper wall 12 of the housing 3 so as to intersect the front end.

The housing 3 has a laterally elongated rectangular shape in a left-to-right direction and includes the horizontal upper wall 12, left and right vertical side walls 13, a rear wall 35 and the lower horizontal bottom wall 8 (FIG. 2). The bottom wall 8 is extended to the front further than the other wall portions 12, 13. A flat circuit element 14 is placed along a lower surface of the bottom wall 8, and a plurality of exposed conductors (not shown) and the like are disposed in parallel at equal intervals on a lower surface of a front end portion of the flat circuit element 14. The flat circuit element 14 is fixedly held by the bottom wall 8 of the housing 3 and a substantially recess-shaped cover 15 of insulating resin, and the cover 15 is fixed by projections 17 on the housing side walls 13 being brought into engagement with hollow portions 16 in both side walls thereof.

The circuit-board-side connector 1 has a connector insertion space 19 between an upper wall 10 and a lower wall (a bottom wall) 18. Elastic contact portions (not shown) of a plurality of parallel terminals 20 of conductive metal are disposed on an upper surface of the lower wall 18 within the connector insertion space 19, and when both the connectors 1, 2 are fitted together, the elastic contact portions are brought into elastic contact with the corresponding exposed conductors, whereby both the connectors 1, 2 are electrically connected together. In FIG. 1, reference numeral 21 denotes an upper disposing groove (a terminal groove) for each terminal 20. The circuit-board-side connector 1 is fixed to a circuit board 23 (FIG. 2) at left and right metallic pieces 22 thereof, and the terminals 20 are connected through soldering to printed circuits (not shown) on the circuit board 23.

The flat-circuit-element-side connector 2 is also referred to as a slider since the same connector 2 is slidably inserted into the circuit board connector 1. The circuit board 23 is a hard (rigid) printed circuit board (PCB). A flexible flat circuit (FFC) or a flexible printed circuit (FPC) is adopted as the flat circuit element 14.

Figure 3:
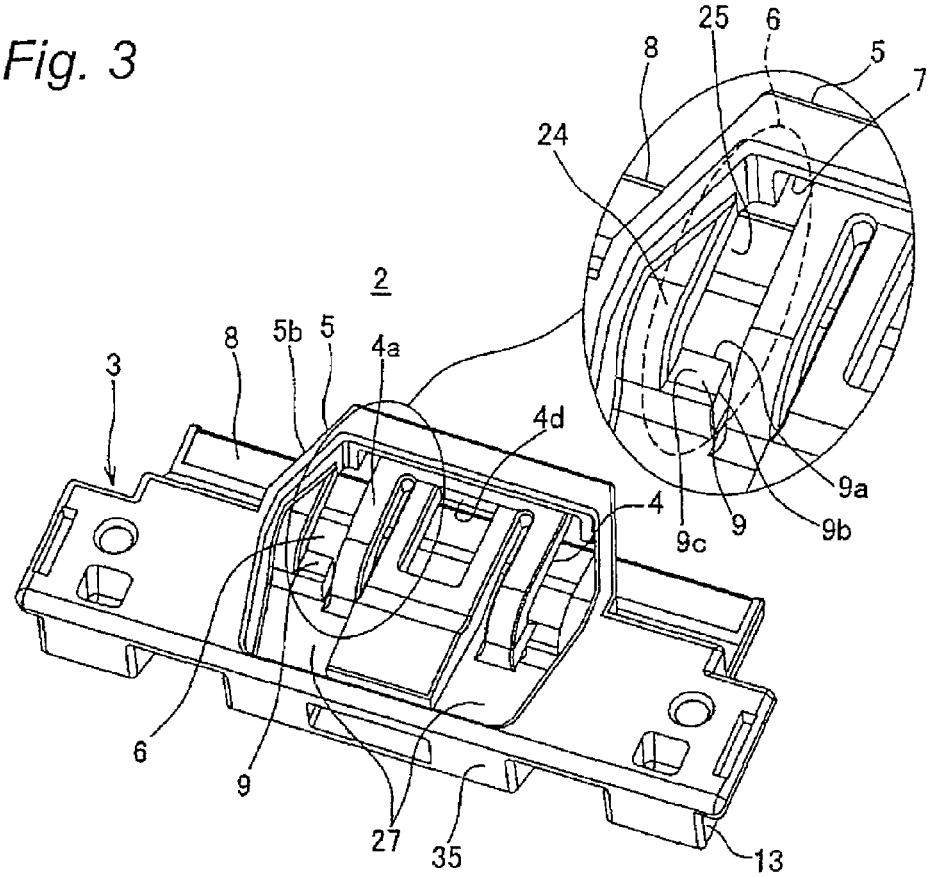
FIG. 3 is a perspective view showing a form of a flat-circuit-element-side connector. A view within a circle is an enlarged view of a main part of the flat-circuit-element-side connector.

FIG. 3 is a perspective view showing the housing 3 alone of the flat-circuit-element-side connector 2.

The projecting portions on the bottom wall 8 of the housing 3 are disposed so as to face lower sides of the lock arm 4 and the arm protection wall 5 which lies outside the lock arm 4. The upper openings or the confirmation openings 6 are positioned individually between the left and right leg portions 4*a* of the lock arm 4 and the left and right side walls 5*b*.

Arch-like curved wall portions 24 are integrally provided on lower sides of the inclined side walls 5*b* of the arm protection wall 5 with a gap provided therebelow. A circuit-board-side connector insertion gap (space) 25 is situated between lower surfaces the arch-shaped wall portions 24 and the upper surface of the bottom wall 8. The fitting position confirmation ribs 9 integrally continue to insides of proximal portions (root portions) of the arch-shaped wall portions 24. The ribs 9 each have a vertical front end face 9*a* and a similar inner surface 9*b*, as well as a horizontal upper end face 9*c*. A bottom portion of the rib 9 integrally continues to the upper surface of the bottom wall 8 of the housing 3. The upper surface 9*c* of the rib 9 is situated lower than the corresponding arch-shaped wall portion 24. The front opening 7 in the front end of the arm protection wall is situated in front of the rib 9 so as to face it.

Figure 4:
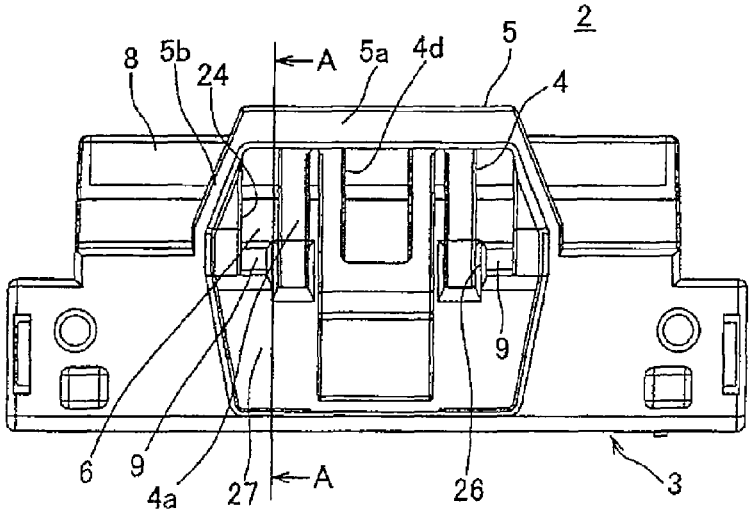
FIG. 4 is a plan view showing the flat-circuit-element-side connector.

FIG. 4 is a plane view showing the housing 3 alone of the flat-circuit-element-side connector 2.

In FIG. 4, reference numerals 4, 5, 24, 6, 9 and 8 denote, respectively, the lock arm, the arm protection wall, the arch-shaped wall portion, the upper opening, the rib and the housing bottom wall 8. The arch-shaped wall portion 24 is formed further inwards and wider than the side wall 5*b* of the arm protection wall 5. An inner surface of the wall portion 24 is vertical and just straight in a front-to-rear direction and is parallel to the leg portion 4*a* of the lock arm 4. The rib 9 and the leg portion 4*a* of the lock arm 4 lie adjacent to each other with a slight gap 26 defined therebetween.

The front end wall 5*a* of the arm protection wall 5 projects further forwards slightly than the front end of the bottom wall 8. Although the upper openings 6 are provided in a front-half of the housing 3, the upper openings 6 communicate with an opening 27 in a rear-half of the housing 3, and the rear-half opening 27 extends to the vicinity of a rear end of the housing 3.

Figure 5:
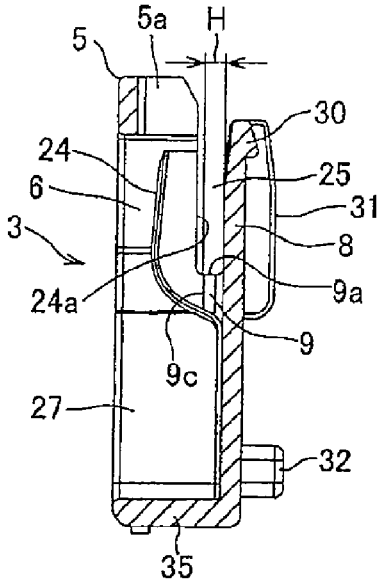
FIG. 5 is a sectional view of the flat-circuit-element-side connector taken along the line A-A in FIG. 4.

FIG. 5 is a sectional view taken along the line A-A in FIG. 4 which shows the housing 3 alone of the flat-circuit-element-side connector 2.

The rib 9 has a short, substantially rectangular cylindrical shape, and a height H of the rib 9 is set so as to be equal to a height of the housing 28 of the circuit-board-side connector 1 when it is fitted to the mating connector completely, when visually confirmed from an obliquely upper position at the rear. The height of the housing 28 is almost the height of an upper surface of the upper wall 10 of the housing 28 of the circuit-board-side connector 1 shown in FIGS. 1, 2, that is, a height of a straight-line portion (a confirmation part) 29 extending along a longitudinal direction of the housing which lies further rearwards slightly than the terminal grooves 21 of the housing 28 shown in FIG. 1. The upper end face 9*c* of the rib 9 is positioned slightly lower than a horizontal lower surface 24*a* of the arch-shaped wall portion 24, and the lower surface 24*a* is positioned at the same level as a lower surface of the vertical front end wall of the arm protection wall 5.

An upper surface of the arm protection wall 5 and the upper surface of the housing 3 continue to each other at almost the same height. A claw portion 30, which is downwardly directed, is provided at the front end of the bottom wall 8 of the housing 3. Elongated guide projections 31 are formed on both left- and right-hand sides of a front-half of the bottom wall 8 so as to be suspended downwards therefrom. A boss portion 32 is provided at a rear portion of the bottom wall 8 so as to project downwards to thereby be brought into engagement with a hole portion in the flat circuit element 14 (FIG. 2) and in a hole portion in the cover 15. The flat circuit element 14 lies along the lower surface of the bottom wall 8 so as to be held between the lower surface and the cover 15. A front end of the flat circuit element 14 is brought into abutment with a rear end face of the claw portion 30, and left and right side edges of the flat circuit element 14 are positioned and guided so as to extend along inner surfaces of the left and right elongated guide projections 31.

The upper openings (the confirmation openings) 6 in the front-half of the housing communicate with the opening 27 in the rear-half of the housing. As is also shown in FIG. 4, the upper openings 6 in the front-half of the housing extend downwards vertically as deep as the housing bottom wall 8 in the gaps with the lock arm 4 within the frame-shaped arm protection wall 5, and the opening 27 in the rear-half of the housing also extends downwards to the housing bottom wall 8.

Figure 6:
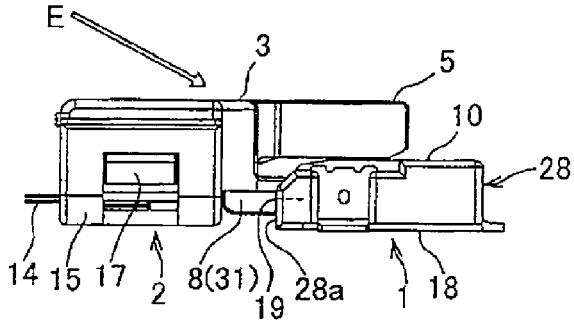
FIG. 6 is a side view showing a state in which the circuit board connecting connector is being fitted together.
Figure 7:
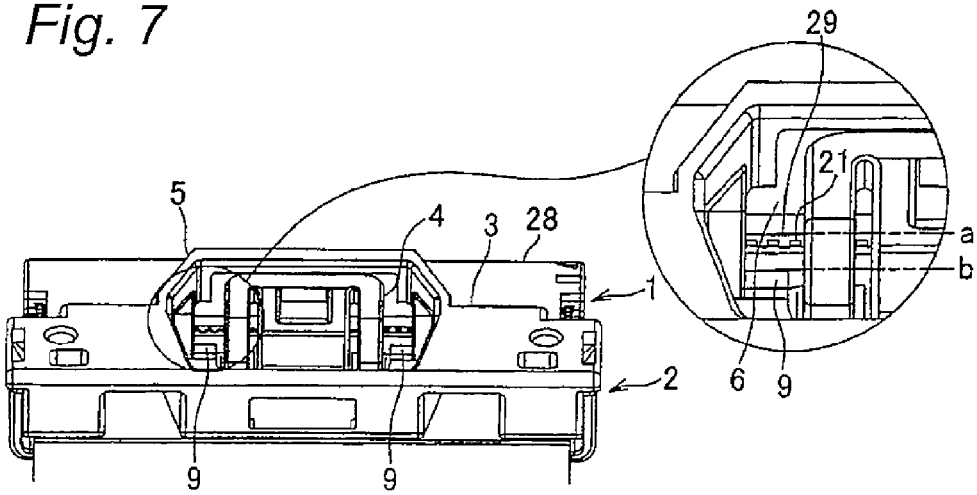
FIG. 7 is a perspective view showing a state as viewed from an obliquely upper position in which the circuit board connecting connector is being fitted together. A view within a circle is an enlarged view of a main part.

FIG. 6 is a side view showing a state resulting in the midst of fitting the flat-circuit-element-side connector 2 to the circuit-board-side connector 1, and FIG. 7 is a perspective view also showing the state resulting in the midst of fitting both the connectors together but seen from an obliquely upper position at the rear.

The expression, "seen from an obliquely upper position at the rear," means that the flat-circuit-element-side connector 2 is seen from an obliquely upper position at the rear of the same connector. A visually confirming direction E (a viewing direction) is shown as an arrow E in FIG. 6. The visually confirming direction E is a direction which intersects the direction in which the flat-circuit-element-side connector 2 is inserted into the circuit-board-side connector 1 so as to be fitted thereto at an acute angle from an obliquely upper position. In this embodiment, this acute angle is generally an angle in the range from 30° to approximately 35° with respect to the inserting and fitting direction (the horizontal direction). In other words, in the state that the flat-circuit-element-side connector 2 is completely fit with the circuit-board-side connector 1, an angle between a straight line connecting the housing lateral line 29 with the vertical front end face 9*a* and the inserting direction is in a range from 30° to 35°. The straight line is on the visually confirming direction E in the state that the flat-circuit-element-side connector 2 is completely fit with the circuit-board-side connector 1. In FIG. 6 and the like, the illustration of the circuit board 23 (FIG. 2) is omitted.

As is shown in FIG. 6, the housing bottom wall 8 of the flat-circuit-element-side connector 2 and an end portion of the flat circuit element 14 which is laid on the lower surface of the bottom wall 8 are initially inserted into the connector insertion space or port 19 defined between the upper and lower housing wall portions 10, 18, and the exposed conductors on a lower surface of the end portion of the flat circuit element 14 are about to contact or are brought into initial contact with the elastic contact portions of the terminals 20 on the lower housing wall portion 18.

When looking at the upper openings 6 on the left- and right-hand sides of the lock arm 4 of the flat-circuit-element-side connector 2 in FIG. 7 in the direction indicated by the arrow E in FIG. 6, as is indicated by parallel chain lines a, b, rear ends of the terminal grooves 21 in the housing 28 of the circuit-board-side connector 1 shown in FIG. 1 and the housing lateral line 29, which lies just close to the terminal grooves 21 therebehind, are seen as being spaced away to the front of the ribs 9 of the flat-circuit-element-side connector 2 from each other, from which it is confirmed that both the connectors 1, 2 are not yet fitted together. As is shown in FIG. 5, the ribs 9 are positioned above rear ends of the elongated guide projections 31 (FIG. 6) at the side portions of the flat-circuit-element-side connector 2. In FIGS. 6, 7, the front end of the circuit-board-side connector 1 is spaced away to the rear from the ribs 9.

Figure 8:
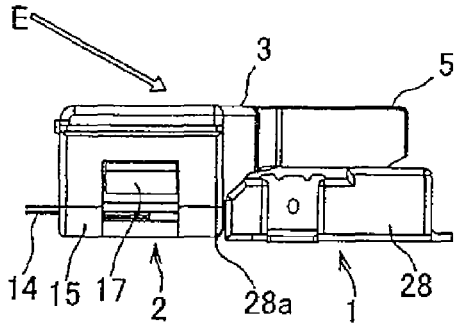
FIG. 8 is a side view showing a state in which the circuit board connecting connecters are fitted together completely.
Figure 9:
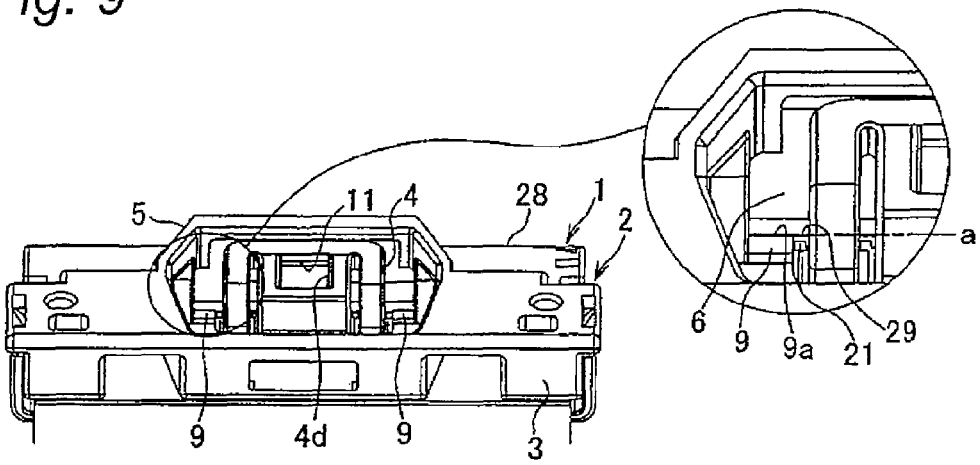
FIG. 9 is a perspective view showing a state as viewed from an obliquely upper position in which the circuit board connecting connector is fitted together completely. A view within a circle is an enlarged view of a main part.

When the flat-circuit-element-side connector 2 is, as is shown in FIGS. 8, 9, fitted completely to the circuit-board-side connector 1, the housing lateral line 29, which lies just close to the terminal grooves 21 in the housing 28 of the circuit-board-side connector 1 behind the terminal grooves 21, is seen as coinciding with the front ends 9*a* of the ribs 9 of the flat-circuit-element-side connector 2 to thereby lie at the same height as the front ends 9*a* on the left- and right-hand sides of the lock arm 4 within the upper openings 6 in the flat-circuit-element-side connector 2 as is shown in FIG. 9, whereby it is confirmed that both the connectors 1, 2 are fitted together completely. FIG. 9 is a drawing seen in the direction indicated by the arrow E), In FIG. 8, the rib 9 is situated at a front end side of the circuit-board-side connector 1. When visually confirmed from the obliquely upper position at the rear, a position where a housing front end 28*a* of the circuit-board-side connector 1 is in abutment with or in contact with the front end 9*a* of the rib 9 in reality is seen as a lateral line at the front end 9*a* of the rib 9 coinciding with the housing lateral line 29*a* lying at an intermediate portion in the connector fitting direction of the circuit-board-side connector 1 to thereby lie at the same height, as is shown in FIG. 9.

Figure 10:
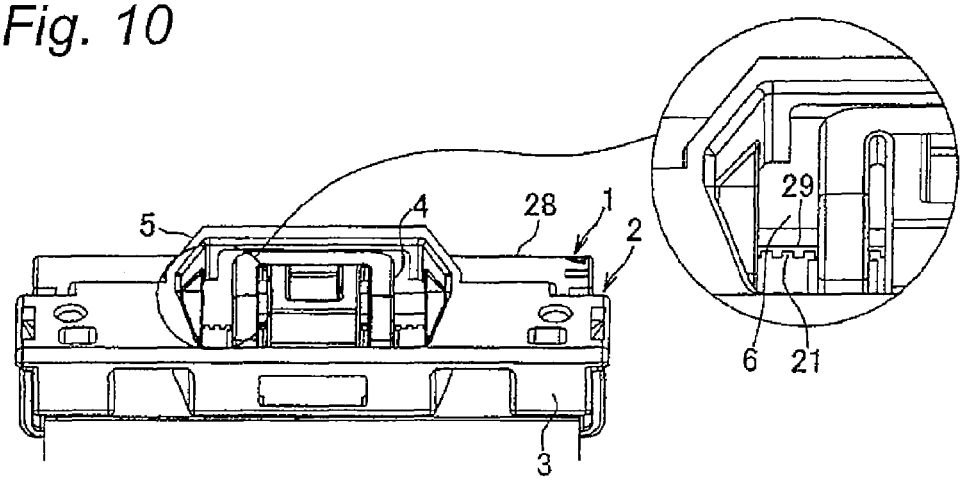
FIG. 10 is a perspective view showing an example as viewed from an obliquely upper position in which no fitting confirmation rib is provided. A view within a circle is an enlarged view of a main part.

FIG. 10 shows an example in which no rib 9 (FIG. 9) is provided within the confirmation openings 6 in the flat-circuit-element-side connector 2. With the flat-circuit-element-side connector 2 fitted completely to the circuit-board-side connector 1, the terminal grooves 21 in the housing 28 of the circuit-board-side connector 1 and the housing lateral line 29 lying just close to the terminal grooves 21 therebehind are visually confirmed within the confirmation openings 6. However, since the reference to the position of the housing lateral line 29 is not clear, although the position of the housing 8 can be confirmed, it is difficult to determine whether or not both the connectors 1, 2 are fitted completely together. In this respect, the role of the ribs 9 (FIG. 9) is important.

In the midst of fitting the connectors together as shown in FIG. 7, the lock projection 11 (FIG. 1) on the circuit-board-side connector 1 is not in engagement with or is in incomplete engagement with the rectangular hollow portion 4*d* in the lock arm 4 of the flat-circuit-element-side connector 2. When the connectors are fitted completely together as is shown in FIG. 9, the lock projection is brought into complete engagement with the hollow portion 4*d* in the lock arm 4. However, the worker cannot confirm the engagement of the lock projection 11 with the hollow portion 4*d* in the lock arm 4 by visually confirming the confirmation openings from the obliquely upper position. Since the ribs 9 are situated further rearwards than the hollow portion 4*d* in the lock arm 4, the ribs 9 can visually be confirmed from the obliquely upper position. The ribs 9 need to be disposed further rearwards than the hollow portion 4*d* in the lock arm 4 or the lock projection 11 when both the connectors are fitted together. Naturally, the confirmation openings 6 needs to be opened as wide as where the ribs 9 are located.

Figure 11:
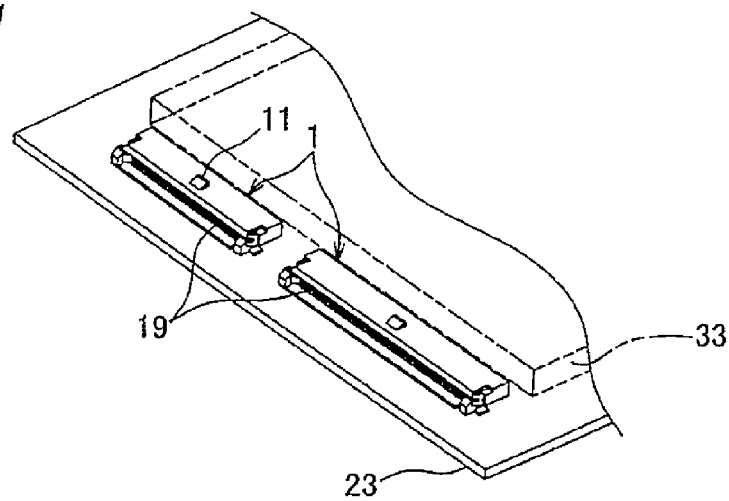
FIG. 11 is a perspective view showing a disposition example of a circuit-board-side connector.
Figure 12:
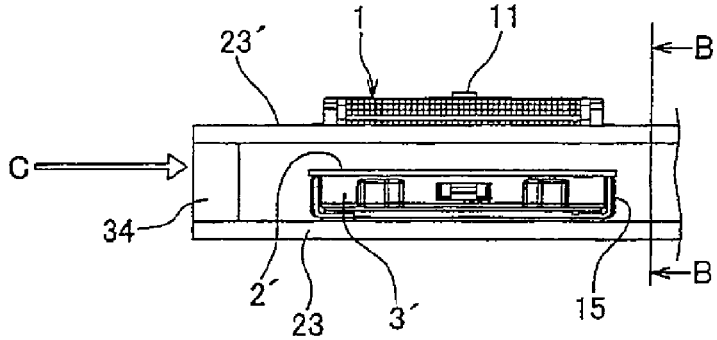
FIG. 12 is a rear view showing another disposition example of circuit board connectors and a fitted state of connectors.
Figure 13:
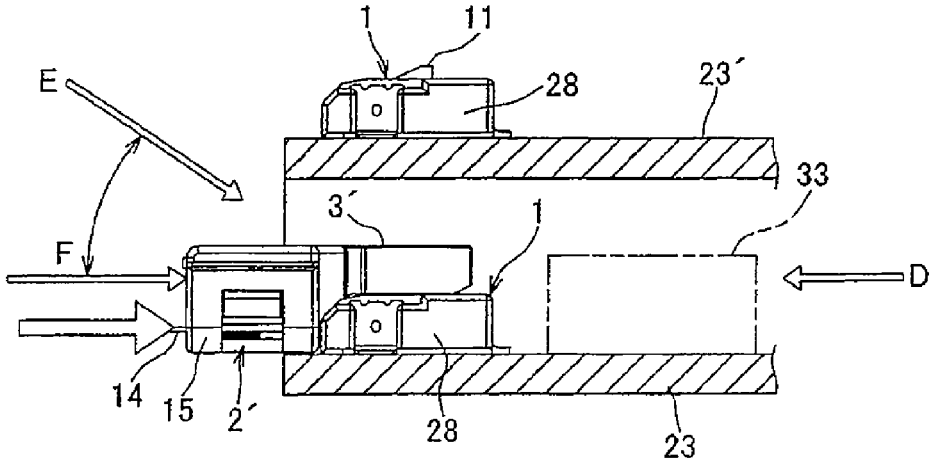
FIG. 13 is a sectional view taken along the line B-B in FIG. 12.

In the circuit board 23 shown in FIG. 2, as is shown in an example depicted in FIG. 11, an other circuit board package part (an other part) such as a type of an electronic part, a connector or a relay is disposed at the rear of the circuit-board-side connector 1 at substantially the same height as or higher than the circuit-board-side connector 1. On an upper side of the circuit board 23 shown in FIG. 2, as is shown in examples in FIGS. 12, 13, an other circuit board 23' (an other part) on which an other circuit-board-side connector 1 is installed is disposed, and the upper and lower circuit boards 23, 23' are connected together by left- and right-hand side connecting walls 34 (other structures).

The upper and lower circuit boards 23, 23' can also be connected together at crucial portions (preferably, side portions) by use of connecting supports in place of the connecting walls 34. The disposition of the circuit boards 23 is not limited to the configuration in which the two upper and lower circuit boards 23 are stacked one above the other, and hence, more than two circuit boards 23 can also be disposed so as to be stacked one above another. For example, when circuit boards 23 are stacked in three stages, for example, the visual confirmation of the fitting of the connectors 1, 2 in the lower and intermediate stages can be implemented from the obliquely upper position above the confirmation openings 6.

In addition, also in a situation in which with a circuit-board-side connector 1 and an other part 33 placed on a single circuit board 23 shown in FIG. 11, not an other circuit board 23' but an other part or an other structure is placed above the circuit-board-side connector 1, the fitting of a connector to the connector can be detected by visual confirmation from the obliquely upper position by use of the fitting confirmation openings 6. In addition, even in such a situation that it is difficult to confirm the fitting of a flat-circuit-element-side connector 2 to a circuit-board-side connector 1 on a single circuit board 23 from above depending on where the worker stands, the visual confirmation on what is seen in the confirmation openings 6 from the obliquely upper position at the rear is effective.

In the embodiment, while the housing lateral line 29 lying just close to the terminal grooves 21 in the circuit-board-side connector 1 behind thereof is described as being the portion which is aligned with the ribs 9, the longitudinal length or height of the ribs 9 may be set as required so that an other portion than the housing lateral line 29 on the housing 28 of the circuit-board-side connector 1. For example, a housing lateral line 36 which lies further rearwards than the housing lateral line 29 in FIG. 1 can perform as the confirmation part. The housing lateral line 29 is produced by a step portion, an end portion of an intersection portion on the housing 3. The longitudinal length and height H of the ribs 9 can be set as required depending upon (in accordance with) a visual confirmation angle from the obliquely upper position.

When a circuit board 23 is disposed not horizontal or perpendicular to the vertical direction but vertical or perpendicular to the horizontal direction, the visual confirmation from the obliquely upper position is implemented from an obliquely side position. In this situation, as a matter of conveniences, it is described that another part is situated above a circuit-board-side connector 1. In addition, while not the pair of left and right confirmation openings 6 but only either the left or right confirmation opening 6 can be provided, by visually confirming both the left and right confirmation openings 6 simultaneously, an oblique fitting of both the connectors 1, 2 can be detected. For example, the oblique fitting in which a left end of the flat-circuit-element-side connector 2 is situated forwards, while a right end is situated at the rear can be detected.

When a plurality of circuit boards are disposed so as to be stacked one above the other, the circuit board connecting connector fitting confirmation construction according to the invention can be made use of to visually confirm whether or not a flat-circuit-element-side connector is fittingly connected completely to a circuit-board-side connector which is disposed between the circuit boards. The plurality of circuit boards stacked can be installed in an electrical junction box or case.

What is claimed is:

1. A fitting confirmation construction of a connector for connecting a circuit board, the connector including a first connector which is provided on the circuit board and a second connector which is provided at a flat circuit element and configured to be inserted into the first connector to be fit, the fitting confirmation construction comprising:

a confirmation part, provided at a housing of the first connector;

a confirmation opening, provided in a housing of the second connector; and a rib, provided in the confirmation opening, wherein a height of the confirmation part is equal to a height of the rib and the confirmation part and the rib are positioned on a same line, on a viewing direction which is viewed through the confirmation opening from an obliquely upper position rearward in an inserting direction of the second connector, in a state that the second connector is completely fit with the first connector.

2. The fitting confirmation construction according to claim 1, further comprising:

a lock arm provided in the housing of the second connector;

outer protection walls, provided on the housing of the second connector, and disposed at a left side and a right side of the lock arm respectively; and a lock projection provided on the housing of the first connector, wherein a pair of confirmation openings are provided between the lock arm and both of the left side and the right side of the outer protection walls respectively, and the rib is disposed rearward of the lock projection in the inserting direction in the state that the second connector is completely fit with the first connector.

3. The fitting confirmation construction according to claim 1, wherein the confirmation part is a straight edge of the housing of the first connector, and in the state that the second connector is completely fit with the first connector, a straight line connecting the straight edge with a front edge of the rib in the inserting direction is equal to the viewing direction, and the front edge is on the straight edge viewed in the viewing direction.

4. The fitting confirmation construction according to claim 3, wherein an angle between the straight line and the inserting direction is in a range from 30 degree to 35 degree.

5. The fitting confirmation construction according to claim 1, wherein at least one other structure is provided above the first connector or above and at sides of the first connector.

* * * * *